United States Patent [19]

Bratzler et al.

[11] 3,966,875

[45] June 29, 1976

[54] PROCESS FOR THE DESULFURIZATION OF GASES

[75] Inventors: Karl Bratzler, Bad Homburg; Alexander Doerges, Frankfurt am Main, both of Germany

[73] Assignee: Metallgesellschaft Aktiengesellschaft, Frankfurt am Main, Germany

[22] Filed: Oct. 11, 1973

[21] Appl. No.: 405,678

[30] Foreign Application Priority Data

Oct. 13, 1972 Germany ..... 2250169

[52] U.S. Cl. ..... 423/220; 423/243; 55/73

[51] Int. Cl.[2] ..... B01D 53/34

[58] Field of Search ..... 423/226, 224, 243, 563

[56] References Cited

UNITED STATES PATENTS

| | | | |
|---|---|---|---|
| 3,098,705 | 7/1963 | Bally | 423/243 |
| 3,324,627 | 6/1967 | Kohrt | 55/73 |
| 3,347,621 | 10/1967 | Papadopoulos et al. | 423/226 |
| 3,387,917 | 6/1968 | Walles et al. | 423/226 |
| 3,622,267 | 11/1971 | Bartholome et al. | 423/243 |
| 3,653,809 | 4/1972 | Wehner et al. | 423/243 |
| 3,664,091 | 5/1972 | Hegwer | 55/73 |
| 3,793,434 | 2/1974 | Leder | 423/228 |

*Primary Examiner*—Earl C. Thomas
*Attorney, Agent, or Firm*—Karl F. Ross; Herbert Dubno

[57] ABSTRACT

A process for desulfurization of fuel or synthesis gases containing carbon oxysulfide wherein the carbon oxysulfide is hydrolyzed by treating the gas at a temperature of 50° to 105°C with a low-volatility organic solvent inert to the carbon oxysulfide and containing 15 to 50 mole-percent water, the hydrolysis products and other sulfur-containing compounds being removed by subsequent scrubbing of the gas.

1 Claim, 2 Drawing Figures

PROCESS FOR THE DESULFURIZATION OF GASES

FIELD OF THE INVENTION

Our present invention relates to a process for the removal of sulfur compounds from fuel and synthesis gases produced by conversion of a carbonaceous or hydrocarbon liquid gaseous or solid fuel to the gaseous state by any of a multitude of conventional processes and, more particularly, to a system of freeing gas streams from carbon oxysulfide in a convenient and economical manner.

BACKGROUND OF THE INVENTION

In the production of fuel and synthesis gases from carbonaceous or hydrocarbon raw materials, e.g. coal or coal-like solids, petroleum and petroleum by-products, refinery or residues and products and the like, the fuel or starting material is subjected to gasification to produce a product which may be rich in one or more of the components: carbon monoxide, methane and hydrogen.

Such gases may be used as fuels or industrial, commercial and residual purposes or may be used as synthesis gases for the production of more complex chemical gases. In the former case, the presence of sulfur or sulfur-containing contaminants give rise to substantial environmental pollution problems while, in the second case, the presence of even small amounts of sulfur or sulfur-containing contaminants may poison or otherwise act detrimentally upon the chemical-synthesis catalyst. In both cases, the presence of sulfur-containing impurities give rise to an increase in corrosion of conduits and equipment for processing or utilizing the gas.

The sulfur compounds in raw fuel gases and synthesis gases consist primarily of hydrogen sulfide, various sulfur-containing organic compounds of the mercaptan type, other sulfides such as carbon disulfides and organic sulfides, and carbon oxysulfide. Carbon disulfide is a significant contaminant when the gases are produced by the coking or gasification of coal.

Only a small part of the carbon oxysulfide contained in such gases can be absorbed by the absorbent solutions hitherto used for the scrubbing of such gases to remove the other sulfur-containing impurities. Consequently, where sulfur contamination is a critical problem, as in the case of synthesis gases to be used in conjunction with sulfur-sensitive catalysts, a fine purification step must be provided to recover the non-absorbent carbon oxysulfide. For this purpose the gas is passed into contact with zinc oxide or iron oxide at temperatures of 300° to 350°C and upon which the carbon oxysulfide is absorbed.

While this process is effective to remove the carbon oxysulfide, it is too expensive to be practical for many industrial purposes since renewal of adsorbent must be carried out frequently, the reaction requires inordinately high temperatures and therefore large amounts of energy, and because the apparatus necessary for carrying out the fine-purification step is relatively expensive. In practice, the use of adsorbent stages of this type has been confined to gases which have been prepurified to a significant degree.

It is also known to remove sulfur-containing impurities from gas streams by chemical action, e.g. by neutralization or chemical-bonded-forming techniques. In these systems, the adsorbents are aqueous or water-containing solutions of strong organic bases or alkali solids of weak inorganic or organic acids. The absorption capacity of such solutions depends upon their alkaline reaction with the carbon-containing contaminants and hence upon the stoichiometry of the reaction. The absorption is most effective with acidic sulfur-containing components such as $H_2S$ and other acidic components such as carbon dioxide present in the gas stream. The absorbent solution is regenerated at atmospheric pressure by heating and the use of a stripping gas. The carbon oxysulfide, however, is substantially uneffected by the absorption process since it is chemically inert to the absorbent under the ambient conditions under which the absorption normally takes place.

It is also known to utilize a physical scrubbing process whereby the gas is treated at a pressure of at least 10 kg/cm$^2$, with an absorbent consisting of neutral organic liquid compounds to which water may be added. Unlike the chemisorption process previously described, the absorption capacity of the organic compounds serving as absorbents does not depend upon the stoichiometry of a chemical reaction but rather of the specific solubilities of the various gas components and, therefore, upon the absorption coefficient or $\alpha$ value. The absorption is also dependent upon the partial pressures of the various gas components and the total pressure. The absorbents are regenerated by flashing to atmospheric pressure and stripping with an inert gas with or without heating.

Because of its low solubility, carbon oxysulfide is generally unsatisfactorily absorbed using physical processes and, indeed, significant absorption only occurs when high flow rates of the solvent are employed and substantial absorption of carbon dioxide can be tolerated.

Because of these problems in the removal of carbon oxysulfide from fuel and synthesis gases, various techniques have been developed which are intended to specifically remove carbon oxysulfide or render the same removable. For example, it has been proposed to react aliphatic amines with carbon oxysulfide to form thiocarbamates and thereby remove the carbon oxysulfide from the gas. The aliphatic amines are generally alkanolamines which, when reacted with carbon oxysulfide are not readily reformed or regenerated. Thus complex regeneration systems have been provided in conjunction with these arrangements, e.g. by treating the alkanolamine/carbon oxysulfide system with water, heating the system and stripping it with a gas. This technique has the obvious disadvantage that it requires a number of steps and considerable equipment for carrying out the process.

It has also been suggested that the gas may be treated in three stages using in the first stage an aqueous solution of ethanolamine hydrolyzing the carbon oxysulfide at a temperature above 60°C to hydrogen sulfide and carbon dioxide, and thereafter scrubbing the hydrolyzed system. The disadvantage with this arrangement, as in the previous case, is that the reaction of carbon oxysulfide and water to yield hydrogen sulfide and carbon dioxide normally favors the decomposition of the carbon oxysulfide although the reaction rate is relatively slow in ambient temperatures. Thus higher temperatures may be required than are otherwise desired. Of even greater significance is the fact that the mass action relationship may be displaced in the opposite direction when the gas contains large quantities of carbon dioxide and hydrogen sulfide and may have a low moisture content. In this case, even concentrations up to about 10% carbon dioxide and hydrogen sulfide result in intolerable concentrations of carbon oxysulfide.

As with the previously described chemisorption processes, the last-mentioned system also has the disadvantage that the acidic gas components hydrogen sulfide and carbon dioxide are jointly recovered and hence that the sulfur-containing product is contaminated with large quantities of carbon dioxide. It is difficult to convert the sulfur compounds to nonvolatile elemental sulfur and sulfuric acid and hence to utilize the sulfur-containing components.

OBJECTS OF THE INVENTION

It is the principal object of the present invention to provide a process for the purification of sulfur-containing gas streams in such manner as to remove carbon oxysulfide therefrom in an economical and convenient manner.

Another object of this invention is to provide an improved system for the removal of sulfur-containing components from a fuel gas or synthesis gas stream whereby the disadvantages of earlier systems may be obviated.

SUMMARY OF THE INVENTION

These objects and others which will become apparent hereinafter are attained, in accordance with the present invention, with a process for the removal of sulfur-containing compounds from a gas stream, especially fuel or synthesis gases produced by gasification of carbonaceous or hydrocarbon raw materials which is based upon our surprising discovery that solvents which have heretofore been used for physical absorption processes can, in the presence of 15 to 50 mole-percent water be contacted with the gas at moderate temperatures of, say, 50° to 105°C and thereby completely convert the carbon oxysulfide to hydrogen sulfide and carbon dioxide. The gas is thereafter subjected to a conventional scrubbing step of the type hitherto used to remove sulfidic sulfur-containing compounds from the gas stream.

The water content of the solvent is critical not only because a surplus of water is required for the hydrolysis reaction but also because excessively high water contents reduce the necessary solvent power ( $\alpha$ value ) of the solvent toward carbon oxysulfide. Thus both the upper and lower limits of the water content are extremely important.

The organic solvent is preferably a nitrogen-containing solvent selected from the group which consists of the lactams or pyrrolidones or piperidones, or a nonnitrogen organic solvent of the polyalcohol or similar type, preferably a polyethylene glycol ether, a polypropylene carbonate, or a butyrolactone. All of these solvents are of the low-volatility group contemplated in accordance with the present invention.

The invention has the advantage that the carbon oxysulfide which is absorbed in the water-containing solvent is decomposed to hydrogen sulfide and carbon dioxide and thus there is no need to separately regenerate the solvent. When equilibrium is established with respect to the hydrogen sulfide and carbon dioxide absorbed, the additional amounts of these substances as formed are completely entrained by the treated gas which carries off the hydrolysis product in the manner of a stripping gas.

To carry out the process according to the invention it is sufficient if solvent which has a suitable water content and is at a temperature above 50°C. is recirculated by a pump at a sufficiently high rate through the absorption tower in which the hydrolysis is effected and through a heat exchanger.

The rate at which the solvent is recirculated through the hydrolysis reactor depends on the solubility of the carbon oxysulfide in the selected solvent in accordance with the equation $$L = \frac{A\,G}{\alpha\,P\,a}$$

wherein

- $L$ is the amount of water-containing solvent in cubic meters per unit of time;
- $G$ is the rate at which gas is fed to the reactor in standard cubic meters per unit of time;
- $A$ is the absorption factor;
- $\alpha$ is the absorption coefficient, standard cubic meters of COS per cubic meter of solvent at 20° C.;
- $P$ is the pressure of the gas entering the reactor; and
- $a$ is the molar proportion of the pure solvent mixed with water.

In this equation, the absorption factor is defined as the ratio of the absorbent to the theoretical solvent requirement corresponding to the equilibrium solubility. An absorption factor of 2 means a surplus of 100% absorbent. The higher the absorption factor, the smaller can be the height of the absorption tower. Solvents which can be used for the hydrolysis according to the invention include preferably nitrogen-containing heterocyclic liquid compounds. Gamma- and delta-lactams, which are alkylated at the nitrogen atom or are substituted by an alkoxy group or oxyalkyl group and which may be substituted at the carbon atoms have also proved satisfactory. Examples are the N-substituted pyrrolidones or piperidones, such as N-methylpyrrolidone, N-methoxypyrrolidone, N-alkyl-epsilon-caprolactam and the like. Other suitable solvents are the tetraalkylated ureas.

The presence of a nitrogen in these compounds appears to promote the hydrolysis of the carbon oxysulfide because a concentrated aqueous solution of imidazole has proved particularly effective in a laboratory test. Other organic solvents which are known as absorbents for use in physical gas-purifying processes and which are free of nitrogen have a lesser effect but this may be improved in that small amounts of a base which cannot enter into irreversible reactions with carbon oxysulfide are added to the solvent-water mixture. Compounds which are suitable for this purpose are secondary or tertiary alkylolamines, such as diethanolamine, triethanolamine, diisopropanolamine, methyldiethanolamine and the like. These bases should be used in amounts of about 0.05 – 0.5 moles per liter of the solvent-water mixture. For use in the hydrolysis of carbon oxysulfide, the nitrogen-free solvents which are known for physical scrubbing, such as the polyglycolethers or propylene carbonate, can be improved by an addition of bases in such small amounts. The hydrolytic action of nitrogen-containing organic solvents can also be increased by an addition of such bases.

Because the solvent-water mixture used for the hydrolysis of the carbon oxysulfide need not be regenerated and is recirculated through the reaction tower, the hydrogen sulfide contained in the treated gas can be scrubbed therefrom by any known physical or chemical absorption process.

The use of an absorption process which is selective for hydrogen sulfide in conjunction with the hydrolysis of carbon oxysulfide in accordance with the invention permits a complete desulfurization because the carbon oxysulfide, which was previously disturbing owing to its low solubility, is eliminated by the hydrolysis. This enables, on the one hand, the recovery of a gas having a high hydrogen sulfide concentration as an exhaust gas produced by the regeneration and, on the other hand, the substantial retention of carbon dioxide in the pure gas so that its burning properties, calorific value, and density can be adjusted to specified values, or enables the maintenance of a desired $CO_2$ concentration in a synthesis gas consisting of CO and $H_2$ and used for the synthesis of methanol. Because hydrogen sulfide is selectively removed by scrubbing, sulfur-free carbon dioxide can subsequently be scrubbed off and recovered or released into the atmosphere.

For instance, the N-alkylated pyrrolidones and piperidones are known from the German Pat. No. 1,154,591 as absorbents which are highly selective for hydrogen sulfide over carbon dioxide.

A plant for carrying out the process according to the invention comprises at least a reaction tower for the hydrolysis of COS and a succeeding absorption tower and a regeneration tower associated therewith.

The solvent-water mixture which is recirculated through the reaction tower and the absorbent which is recirculated through the absorption and regenerating towers are conducted in basically separate cycles. This will also be the case if the solvent and absorbent contain the same organic substance because this substance has different water contents and temperatures in the two process stages.

For the treatment of some gases it may be of advantage to scrub off part of the acid components, $H_2S$ and $CO_2$, and preferably to selectively scrub off hydrogen sulfide, before the hydrolysis of carbon oxysulfide according to the invention. It is desirable to use for this preliminary scrubbing the same absorbent as in the complete desulfurization which follows the hydrolysis of COS. In that case, a common regeneration unit is associated with both absorption stages, the laden absorbent from the last absorption stage is fed to the first absorption stage at the top thereof, and the fully laden absorbent from the first absorption stage is fed to the regenerating system, from which the regenerated scrubbing agent is fed to the last absorption system.

DESCRIPTION OF THE DRAWING

The above and other objects, features and advantages of the present invention will become more readily apparent from the following description, reference being made to the accompanying drawing in which.

SPECIFIC DESCRIPTION

Figure 1:
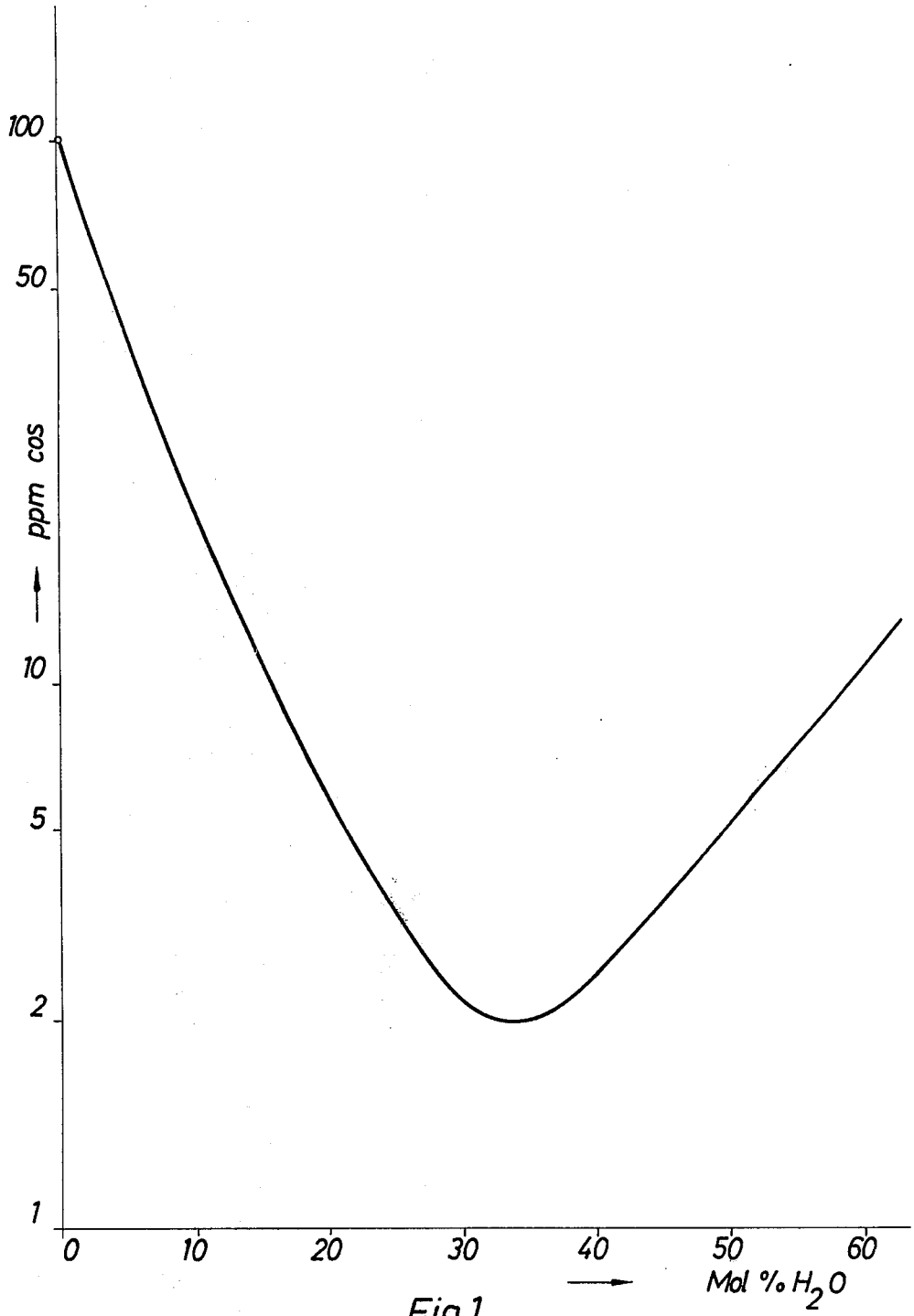
FIG. 1 is a diagram illustrating the relationship of the mole fraction of water in the solvent system and the removal of carbon oxysulfide.

In FIG. 1, we have shown the criticality of the water content of the solvent. The drawing has the mole fraction of water plotted along the abscissa in mole percent and the hydrolysis of carbon oxysulfide in parts per million plotted along the ordinate. The graph was made for a gas containing 100 parts by million of carbon oxysulfide by volume and treated at a temperature of 60°C at a pressure of 20 kg/cm$^2$ with a mixture of N-methyl pyrrolidone and up to 60 mole percent water. In the pure solvent, of course, there is no hydrolysis and as the water content increases to about 33 mole percent, the nonhydrolyzed residue of carbon oxysulfide decreases to 2 parts per million. The residue (unaffected carbon oxysulfide) rises with increasing water content beyond this point.

It has been found that water contents below 15 mole percent result in intolerable quantities of carbon oxysulfide in the effluent gases and that above 50 mole percent, the solvent has unsatisfactory solvent power for the carbon oxysulfide.

It should be apparent from the diagram that the preferred mole fraction of water is between 25 and 40% and preferably 30 to 35 mole percent.

Figure 2:
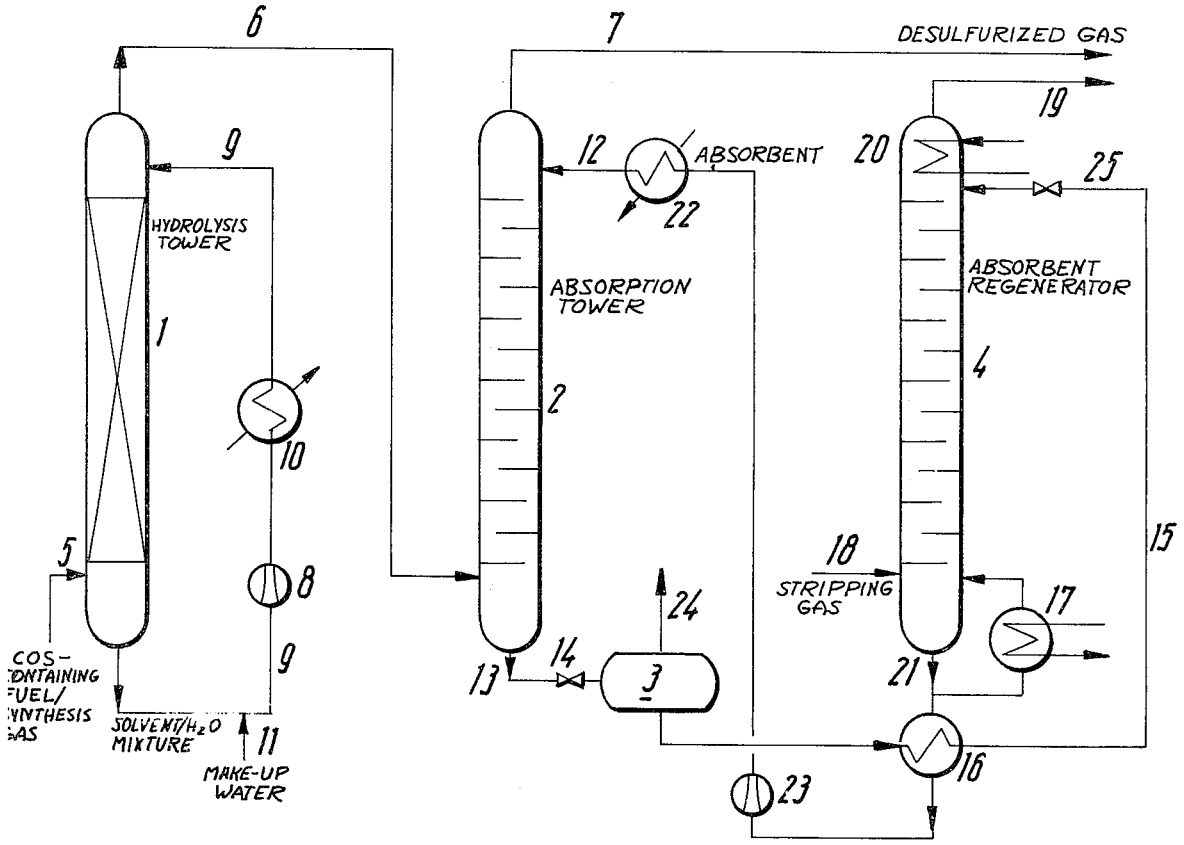
FIG. 2 is a flow diagram of a plant for the removal of sulfur-containing components from a gas stream according to the present invention.

FIG. 2 shows the flow scheme of a plant for carrying out the process according to the invention. The plant consists essentially of a reaction tower 1 for the hydrolysis of COS, an absorption tower 2 for the complete desulfurization and an associated regenerating system comprising a pressure relief vessel 3 and a regenerating tower 4.

The COS-containing gas enters the reaction tower at the bottom thereof through conduit 5 and gas which is free of COS flows from the top of the reaction tower through conduit 6 to the sump of the absorption tower 2. The completely desulfurized gas is withdrawn from the top of the absorption tower 2 through conduit 7 for utilization. In the reaction tower 1, the solvent-water mixture for the hydrolysis of COS is recirculated by a pump 8 to flow through a conduit 9, a heater 10 and from the sump to the top of the reaction tower 1.

In the heater 10, the solvent-water mixture is maintained at a temperature which is sufficient for the hydrolysis of COS. To make up for the water losses which are due to the evaporation into the treated gas, water is supplied through conduit 11 into the recirculating conduit 9. Little power is required to operate the pump 9 and heater 10 because the solvent-water mixture is recirculated substantially without a loss of heat and pressure.

The absorbent for the complete desulfurization is fed through a conduit 12 to the absorption tower 2 at the top thereof. The laden absorbent is withdrawn from the sump of the absorption tower 2 and fed into the pressure relief vessel 3 through a conduit 13, which incorporates a pressure relief value 14. The pressure relief-vessel 3 may be provided in a plurality of stages in known manner, so that the useful gas components excaping through conduit 24 after a pressure relief to an intermediate pressure can be separately recovered and after a recompression can be returned into the gas which flows through conduit 6 to the absorption stage. After its preliminary degasification in the pressure relief vessel, the absorbent is fed in conduit 15 through a heat exchanger 16 and a pressure relief valve 25 to the top of the regenerating tower 4 and in the latter flows downward opposite to the gases and vapors rising from the sump. The sump of the regenerating tower 4 is heated by recirculation through a heater 17. A stripping agent, such as an inert gas or water vapor, may be introduced into the sump of the regenerating tower 4 through a conduit 18. The exhaust gas produced by the regeneration is passed through a cooler 20 at the top of the column to retain the condensible components and is then discharged through a conduit 19 for further utilization. The regenerated absorbent is returned from the sump to the regenerating tower through a conduit 21, a heat exchanger 16, a cooler 22 and the conduit 12 leading to the top of the absorption tower by means of a pump 23.

SPECIFIC EXAMPLES

Example 1

A natural gas which is under a pressure of 75 bars and composed of

| | |
|---|---|
| $CO_2$ | 6.0% by volume |
| $H_2S$ | 0.5% by volume |
| $CH_4$ | 93.5% by volume |
| COS | 100 ppm |

is to be desulfurized as completely as possible before it is delivered as a utility gas to a long-distance pipeline system.

At a rate of 89,544 standard cubic meters per hour, this gas is fed into the reaction tower 1 through the conduit 5. This reaction tower contains over a height of 10 meters a layer of packing bodies. N-methylpyrrolidone and water is fed from above at a rate of 500 cubic meters per hour from the conduit 9. This mixture has a water content of 35 mole per cent. The mixture is recirculated by means of the pump 8 through the reaction tower 1 and the heater 10 and in the latter is heated to a temperature of 65°C. Flowing through the reaction tower, the mixture in contact with the gas to be treated is cooled to 55°C. The rate at which the mixture is recirculated is selected so that the absorption factor A equals 1.36. 98% by volume or 8.8 standard cubic meters per hour of the COS contained in the raw gas are hydrolized in the reaction tower 1 to form 8.8 standard cubic meters $H_2S$ and 8.8 standard cubic meters $CO_2$ per hour. Together with the amounts of $H_2S$ and $CO_2$ which have been dissolved out of the raw gas, these hydrolysis products are stripped from the solvent mixture entering the reaction tower through the conduit 9 by the gas which leaves through the conduit 6 and are transferred into the succeeding selective desulfurization plant consisting of the absorption tower.

By the $H_2S$ and $CO_2$ formed by the hydrolysis of COS and amounting to 17.6 standard cubic meters per hour the rate at which the gas enters the absorption tower 2 is slightly increased to 89,562 standard cubic meters per hour.

In the absorption tower 2, the gas is scrubbed with an absorbent consisting of N-methylpyrrolidone which has a water content of 5 mole percent $H_2O$. The absorbent rate is 80 cubic meters per hour. As a result, $H_2S$ and COS are scrubbed off to a residual concentration of about 3 ppm. Besides, $CO_2$ at a rate of 1080 standard cubic meters per hour and some methane are absorbed. The pure gas is delivered to the long-distance pipeline system at a rate of 87,900 standard cubic meters per hour and has the following composition:

| | |
|---|---|
| $CO_2$ | 4.9% by volume |
| $H_2S$ | 2 ppm |
| COS | 1 ppm |
| $CH_4$ | 95.1% by volume. |

The laden absorbent drained from the absorption tower 2 is fed into the vessel 3 through the pressure-relief valve 14, which causes a pressure relief to a medium pressure of 15 bars so that a high-methane intermediate fraction is released, which is withdrawn as a fuel gas through a conduit 24. After this preliminary pressure relief, the absorbent is fed through conduit 15 and heat exchanger 16 to a valve 25, in which it is subjected to a pressure relief to ambient pressure, and is then fed to the top of the regenerating tower 4.

By means of the reboiler 17, a temperature of 160°C is adjusted in the sump of the regenerating tower. Additional $CO_2$ at a rate of 780 standard cubic meters per hour are introduced as a stripping gas through conduit 18.

The exhaust gas from the regenerating tower is withdrawn from the top thereof through conduit 19 at a rate of 2328 standard cubic meters per hour and contains 19.2% by volume $H_2S$ and only traces of COS. The remaining 80% by volume consist of $CO_2$.

The regenerated absorbent is withdrawn from the sump of the regenerating tower 4 and recirculated through the conduit 21, the heat exchanger 16, the cooler 22 and the conduit 12 to the top of the absorption tower 2. The absorbent is cooled in the cooler 22 to adjust a temperature of about 30°C in the absorption tower.

Example 2

A natural gas which has been dried and is available under pressure of 75 bars and at 20°C is composed of

| | |
|---|---|
| $CO_2$ | 9% by volume |
| $H_2S$ | 10% by volume |
| $CH_4$ | 76% by volume |
| $N_2$ | 5% by volume |
| COS | 150 ppm (vol.) |

For delivery as a utility gas to a long-distance pipeline system, the gas is to be desulfurized virtually completely, to residual sulfur concentrations below 3 ppm. The $CO_2$ content should substantially remain in the pure gas.

For the treatmnt of this gas, the plant shown in FIG. 2 is modified in known manner. The reaction tower for the hydrolysis of COS is preceded by another absorption tower, in which the raw gas is scrubbed to remove most of the high $H_2S$ content. The solvent is conducted in known manner through the two absorption towers. The absorbent which has been laden in the absorption tower 2 of FIG. 2 is fed to the top of the first absorption tower which precedes the COS hydrolysis unit. As a result, the absorbent is fully laden in said first absorption tower.

From the sump of the first absorption tower, the absorbent is fed to the tower 4 for regeneration, and fully regenerated absorbent is fed to the second absorption tower. As a result, the gas components which have been scrubbed off in the two absorption stages are available in a single stream of exhaust gas produced by the regeneration. The absorbend used in both stages is N-methylpyrrolidone having a water content of 8 mole per cent. It is recirculated at such a rate that 80 cubic meters of absorbent per hour are fed to each of the two absorption towers. In the first absorption tower, raw gas having the composition stated above and fed at a rate of 100,000 standard cubic meters per hour is scrubbed at a temperature of 35°–40°C to remove 9,950 standard cubic meters $H_2S$, 500 standard cubic meters $CO_2$, and 6 standard cubic meters COS per hour so that only 40% by volume of the COS contained in the raw gas are absorbed. As a result, the reaction tower for the hydrolysis of COS is fed at a rate of 89,544 standard cubis meters per hour with the prescrubbed gas having the following composition:

| | |
|---|---|
| $CO_2$ | 9.5% by volume |
| $H_2S$ | 559 ppm |
| $CH_4$ | 84.8% by volume |
| $N_2$ | 5.6% by volume |
| COS | 100 ppm. |

The reaction tower 1 in FIG. 2 contains in a height of 10 meters a layer of commercial packing bodies, such as Raschig rings or Berl saddles. In the manner described in Example 1, solvent consisting of N-methylpyrrolidone containing 35 mole per cent water is recirculated through the reaction tower at a rate of 500 cubic meters per hour. The absorption factor $\alpha$ thus amounts to 1.36. The solvent is fed to the top of the reaction tower at a temperature of 65° C and in said tower is cooled to 55° C in contact with the gas. As the solvent is recirculated, it is reheated in the heater.

The volume of the gas treated in the reaction tower has been slightly increased to 89,562 standard cubic meters per hour because the $H_2S$ and $CO_2$ produced by the hydrolysis of COS have been added. This treated gas is scrubbed in the second absorption tower with N-methylpyrrolidone-water mixture containing 8 mole per cent water and supplied at a rate of 80 cubic meters per hour. The pure gas obtained at a rate of 86,490 standard cubic meters per hour has the following composition:

| | |
|---|---|
| $CO_2$ | 7.1% by volume |
| $H_2S$ | 2 ppm |
| $CH_4$ | 87.3% by volume |
| $N_2$ | 5.6% by volume |
| COS | 1 ppm. |

This gas is delivered to the long-distance pipeline system.

From the first absorption tower, the laden absorbent is fed to the regeneration unit, in which the absorbent is regenerated as described in Example 1 by being pressure-relieved and heated but without being stripped. An exhaust gas composed of:

| | |
|---|---|
| $H_2S$ | 76.3% by volume |
| $CO_2$ | 22.5% by volume |
| $N_2+CH_4$ | 1.2% by volume |
| COS | 450 ppm |

is produced by the regeneration at a rate of 13,110 standard cubic meters per hour.

Example 3

A raw gas recovered by an autothermic gasification of coal with oxygen and water vapor and available at a rate of 90,000 standard cubic meters per hour should be desulfurized before being processed to synthetic natural gas. The gas is at 28°C and under a pressure of 20 bars and contains 10% by volume $CO_2$, 1.1% by volume $H_2S$, and 0.018% by volume COS. By a selective prescrubbing with N-methylpyrrolidone, the $H_2S$ is removed to a residual content of 300 ppm. 40% of the COS are also removed by this scrubbing so that the pre-desulfurized gas contains 300 ppm $H_2S$, 110 ppm COS, and 8.5% by volume $CO_2$. The exhaust gas produced by the regeneration associated with the pre-desulfurization contains 40% by volume $H_2S$ and may be processed in a Claus process to form elementary sulfur.

In a plant as shown in FIG. 2, the pre-desulfurized gas is treated in a reaction tower 1 at 60°C with a mixture of N-methylpyrrolidone, 0.3 mole diethanolamine per liter and 36 mole per cent water. This mixture is supplied at a rate of 450 cubic meters per hour. The leaving gas contains only 1 ppm COS but contains 409 ppm $H_2S$. It is first indirectly cooled and additionally scrubbed with some water to recover N-methylpyrrolidone which has evaporated into the gas, and is then fed to a final desulfurization unit, which is operated with an alkaline aqueous solution of sodium arsenite and sodium arsenate. The leaving gas has a COS content of only 0.5 ppm and a $H_2S$ content of 0.2 ppm and may be processed to synthetic natural gas. The laden scrubbing solution draining from the final scrubbing unit is regenerated in known manner by bubbling air therethrough with formation of elemental sulfur and after the separation of the sulfur is recycled to the final scrubbing unit. Elemental sulfur is recovered at a rate of 36 kilograms per hour and can be admixed with the sulfur produced in the Claus plant.

In this process, the hydrolysis of COS according to the invention is combined with two different selective desulfurizing processes. The chemical scrubbing step for fine purification results in a pure gas having particularly low concentrations of residual sulfur whereas the sulfur compounds removed by scrubbing are converted into elemental sulfur by the regeneration. This elemental sulfur can be combined with the product of the processing of the exhaust gas produced by the regeneration associated with the preliminary scrubbing.

Example 4

A natural gas which is under a pressure of 50 bars and contains 120 ppm $H_2S$ is intended to be delivered to a long-distance pipeline system and before such delivery is desulfurized to a residual content of 1 ppm $H_2S$ in a scrubber through which anhydrous polyethyleneglycol-dimethylether is recirculated. The laden scrubbing solution is regenerated in known manner by being stripped with air. To increase the supply of natural gas, the existing plant should be alternatively used to desulfurize a natural gas which contains 105 ppm $H_2S$ and 45 ppm COS. Because only a small amount of COS can be removed in the existing plant by the scrubbing with the solvent, the plant is preceded by an additional reaction tower 1, which is connected in the gas stream according to FIG. 2 and which is operated at 60° C with an absorbent consisting of polyethyleneglycol-dimethylether which contains 25 mole per cent water and 0.3 mole diethanolamine per liter. As a result, the COS contained in the gas is hydrolyzed and the gas which enters the previously existing plant then contains 149 ppm $H_2S$ but only 1 ppm COS. The gas is scrubbed with virtually anhydrous polyethyleneglocol-dimethylether at 28°C and is thus completely desulfurized to a residual content of 1 ppm $H_2S$ and 0.5 ppm COS.

Example 5

The following experimental set-up has been used to compare and test different organic solvents as to their suitability for the hydrolysis of COS according to the invention. For these comparison tests, a gas mixture of nitrogen, 10% by volume $CO_2$, and 118 ppm COS was prepared and was passed under atmospheric pressure and at a rate of 30 liters per hour through two laboratory bubblers, which were connected in series. In each of these bubblers, 50 milliliters of the solvent-water mixture were kept at a temperature of 60° C. After three hours, the gas flowing out of the second bubbler was analyzed as to its hydrogen sulfide content.

In the subsequent Table, the $H_2S$ contents of the gases treated with the respective solvents are stated:

| | |
|---|---|
| 1) Tributylphosphate containing 13 mole per cent water | 0 ppm $H_2S$ |
| 2) Tetrahydrothiophendioxide containing 35 mole per cent water | 17 ppm $H_2S$ |
| 3) N-methylpyrrolidone containing 35 mole per cent water | 66 ppm $H_2S$ |
| 4) N-methylimidazole containing 35 mole per cent water | 94 ppm $H_2S$. |

In the tributylphosphate (1), the COS was not attacked and passed the solvent-water mixture without change.

In the tetrahydrothiophendioxide (2), about 15% of the COS content were hydrolized, in the N-methylpyrrolidone 44% and in the N-methylimidazole 80%.

We claim:

1. A process for the desulfurization of a raw fuel or synthesis gas containing carbonyl sulfide and hydrogen sulfide which comprises the steps of:

a. treating the gas at a temperature of 50° to 105°C with a low volatility organic solvent miscible with water and selected from the group consisting of N-substituted pyrrolidone, N-substituted piperidones, and polyethylene glycol ethers said solvent containing 15 to 50 mole% water to selectively dissolve the carbonyl sulfide and yield a gas free from carbonyl sulfide said solvent being chemically inert with respect to reaction with carbonyl sulfide in the absence of water and wherein the rate at which said solvent is contacted with said gas is selected to maintain an absorption factor of at least 1 for carbonyl sulfide in terms of the anhydrous solvent constant rate;

b. hydrolyzing the carbonyl sulfide dissolved in the solvent with water combined therewith simultaneously with the treatment of step (*a*) to transform the solution of dissolved carbonyl sulfide to hydrogen sulfide and carbon dioxide and stripping the solvent laden with the hydrogen sulfide formed by the hydrolysis of the carbonyl sulfide with a further part of the raw gas simultaneously with step (*a*); and c. subsequently scrubbing said carbonyl sulfide-free gas to remove therefrom hydrogen sulfide.

* * * * *